US006485574B1

(12) United States Patent
Chou et al.

(10) Patent No.: US 6,485,574 B1
(45) Date of Patent: Nov. 26, 2002

(54) PROCESS FOR PRETREATING COLORED AQUEOUS SUGAR SOLUTIONS TO PRODUCE A LOW COLORED CRYSTALLIZED SUGAR

(76) Inventors: Chung-Chi Chou, 1622 Frankfort St., New Orleans, LA (US) 70122; Ya-Guang Min, 1315 Bough Beeches Blvd. Apt. 705, Mississauga, Ont. (CA), L4W4A1; Da-Wei Gao, 1111 Lake Ave. Apt. 209, Metairie, LA (US) 70005; Marc-Andre Theoleyre, 14, rue Montecristo, 75020 Paris (FR)

( * ) Notice: Subject to any disclaimer, the term of this patent is extended or adjusted under 35 U.S.C. 154(b) by 0 days.

(21) Appl. No.: 09/599,954

(22) Filed: Jun. 23, 2000

(51) Int. Cl.[7] ..... C13D 3/10
(52) U.S. Cl. ..... 127/46.2; 127/48
(58) Field of Search ..... 127/46.2, 48

(56) References Cited

U.S. PATENT DOCUMENTS 3,926,662 A * 12/1975 Rundell et al. ..... 127/48
4,247,340 A * 1/1981 Cartier ..... 127/48
5,096,500 A * 3/1992 San Miguel Bento ..... 127/46.2
5,865,899 A * 2/1999 Theoleyre et al. ..... 127/42

* cited by examiner

*Primary Examiner*—David Brunsman
(74) *Attorney, Agent, or Firm*—Roylance, Abrams, Berdo & Goodman, L.L.P.

(57) ABSTRACT

Process for manufacturing crystallized sugar from an aqueous sugar solution containing colorants, polyvalent cations such as $Ca^{2+}$ and $Mg^{2+}$ ions and possibly polyvalent anions, said process comprising the step of submitting said solution to a crystallization procedure to obtain a crystallized sugar, the process being characterized in that, in order to decrease the occlusion of colorants in the crystals of said crystallized sugar, it further comprises the step of treating said solution so as to increase the number of polyvalent anion equivalents such as adding $CO_B^-$ anions with regard to the number of polyvalent cation equivalents in said solution.

14 Claims, 3 Drawing Sheets

PROCESS FOR PRETREATING COLORED AQUEOUS SUGAR SOLUTIONS TO PRODUCE A LOW COLORED CRYSTALLIZED SUGAR

FIELD OF THE INVENTION

The present invention concerns the field of refined low colored sugar manufactured from a colored aqueous sugar solution.

BACKGROUND OF THE INVENTION

In the beet sugar production, a beet refined granulated sugar with 20–30 ICUMSA color units (abbreviated I.C.U. hereafter) is usually crystallized from a standard feed liquor of about 3000 I.C.U. and 94% sugar purity. For example, a beet standard liquor of 2864 I.C.U. gives a sugar of 29 I.C.U.

However, a cane refined sugar with 20–40 I.C.U. is generally produced from standard feed liquor of 200 to 300 I.C.U. and 99% sugar purity.

Thus, it appears that the occlusion (adsorption/absorption) of colorants into refined sugar crystals is considerably greater for cane refined sugar production. Therefore, for production of cane refined sugar, extracted sucrose from sugar cane is first produced in the form of cane raw sugar with a color ranging from 1500 to 6000 I.C.U. in a raw sugar mill. The cane raw sugar is then further refined into final refined sugar product, with a color ranging from 20 to 50 I.C.U. in a sugar refinery.

The refining process primarily is a decolorization process using (a) mechanical separation (affination); (b) chemical color separation (carbonation or phosphatation); (c) physical separation (ion exchange resin, granulated activated carbon bone char process, etc.); and (d) final crystallization, which also transforms sucrose into soluble solid granulated sugar. Steps (a) and (b) can be classified as "primary decolorization". Step (c) can be classified as secondary decolorization.

The above refining process is extremely cost intensive in both capital investment and operation cost, particularly in energy requirement and plant maintenance. If a carbonation or phosphatation process is used, disposal of carbonate cake or phosphate scum is increasingly an environmental problem. If a cane refined sugar with a color of 30 to 70 I.C.U. could be crystallized from a standard cane liquor of 3000 I.C.U. color, as it is the case of beet sugar production, then the entire refinery decolorization steps, e.g. affination, carbonation/phosphatation, ion exchange resin, all can be eliminated resulting in a tremendous saving in both capital, operation and disposal cost. Furthermore, if cane refined sugar of 30 to 60 I.C.U. could be crystallized from a cane raw sugar mill's evaporated syrup with a color ranging from 5000 to 10,000 I.C.U., refined sugar could be produced in raw sugar mills. At any rate, if cane refined sugar could be crystallized from a standard liquor having a color anywhere between 500 to 10,000 I.C.U., selective refining process step could be eliminated resulting in considerable saving in refined sugar production.

The distinct difference in occlusion characteristics, thereafter termed as "occlusion index", between beet sugar and cane sugar colorants has been a subject of speculation and postulation for many years. That "occlusion index" is defined as the color ratio between the color of the sugar and the color of the crystallization liquor: O.I.=100×col. Sugar / col. Syrup.

Because of the inability of the researchers in the field to adequately explain it, with some degree of technical and scientific certainty, the obvious difference in occlusion between beet and cane colorants are generally attributed to the nature of the colorants which have been studied by Lionnet, G. R. E. [(1987), Impurity transfer during A-massecuite boiling, Proc. S. African Sugar Technol. Assoc., p. 70 and Shore, M., Broughton, N.W. et al. (1984), Factors affecting white sugar color, Sugar Technology Review. 12:1–99].

Recent studies, Godshall, M. A. and Clarke, M. A., ["High molecular weight color in refineries", *Proc. Conf Sugar Process. Research*, pp. 75–95, (1988)] indicated that the high molecular weight colorants are preferentially occluded. Donovan, M. and Williams, J. C., ["The factors influencing the transfer of colour to sugar crystals", *Proc. Conf. Sugar Process. Research*, pp. 31–48, (1992)], in a study on color transfer, also seem to have a similar finding. Although the findings of these studies are subject to speculation, they pointed to the need to search for the cause of preferential occlusion in crystals in order to find a solution to reduce "the occlusion index" of feed liquor colorant.

The so-called NAP process developed by APPLEXION (U.S. Pat. No. 5,554,227 and U.S. Pat. No. 5,902,409) showed that, by using a system as tight as a filtration membrane, due to the removal of high molecular weight molecules, the color of the sugar is drastically reduced with respect to the direct decolorization of the juice. With such a NAP process, a decreasing of the occlusion index is observed; moreover, approximately 40 to 50% of color and ash reduction is observed on crystalized sugar.

Carpenter, F. and Deitz, V. R. (Technical report, NBS report 7750, Bone char Research Project, Inc., NBS project 1502-20-15122, 19–69, 1962) clearly showed that adsorption of colorants by bone char is greatly diminished in the presence of an excess polyvalent anions. This indicates that comparatively small changes in the ionic composition of a liquor/syrup may cause a large change in the effluent liquor, i.e. color is not "picked-up" by the bone char. In other words, an excess of polyvalent anions in a sugar solution containing colorants, will reduce the adsorption/absorption of said colorants on bone char, resulting in a poor decolorization by the bone char. However, if the colorant molecular weight is high enough, adsorption by granular carbon can be anticipated.

The present invention is based on the hypothesis that occlusion (adsorption/absorption) of colorants into sugar crystals during a crystallization process, could follow the same rules as adsorption on bone char.

This hypothesis has been thoroughly studied by the inventors.

DESCRIPTION OF THE INVENTION

Therefore, in one aspect, the present invention concerns a process for decreasing the occlusion of colorants in sugar crystals during the crystallization step of an aqueous sugar solution containing colorants, polyvalent cations such as $Ca^{2+}$ and $Mg^{2+}$ ions and possibly polyvalent anions, said process being characterized in that it comprises the step of treating said solution so as to increase the number of polyvalent anion equivalents with regard to the number of polyvalent cation equivalents.

In a further aspect, the present invention concerns a process for manufacturing crystallized sugar from an aqueous sugar solution containing colorants, polyvalent cations such as $Ca^{2+}$ and $Mg^{2+}$ ions and possibly polyvalent anions, said process comprising the step of submitting said solution to a crystallization procedure to obtain a crystallized sugar, the process being characterized in that, in order to decrease the occlusion of colorants in the crystals of said crystallized sugar, it further comprises the step of treating said solution so as to increase the number of polyvalent anion equivalents with regard to the number of polyvalent cation equivalents.

According to this invention, it is possible to reduce the occlusion of colorants in the sugar crystals, that is to reduce the above-defined occlusion index and, hence, to obtain less colored sugar crystals.

Advantageously, the treating step according to the present invention comprises the step of adding a source of polyvalent anions to said solution.

The treating step in the above processes may lead to a solution containing an excess of polyvalent anion equivalents with regard to the polyvalent cation equivalents.

Having in mind that a beet or cane sugar solution usually contains mainly chloride as monovalent anions and $Ca^{2+}$ and $Mg^{2+}$ as polyvalent cations, such an excess of polyvalent anion equivalents (EPA) for such a sugar solution may generally be expressed as follows:

$$EPA=TA-Cl^{-}-Ca^{2+}-Mg^{2-}$$

wherein TA=total anion equivalents, and $TA-Cl^{-}$=polyvalent anions equivalents.

The source of polyvalent anions which may be added to the solution to be treated is preferably chosen among the materials which, when added to said solution, do not decrease the pH of the latter.

The source preferably provides polyvalent anions chosen among $PO_4^{3-}$ ions, $SO_4^{2-}$ ions, $SO_3^{2-}$ ions, $CO_3^{2-}$ ions and the combinations thereof, but the invention is not limited to such particular source of polyvalent anions.

The source of polyvalent anions is more preferably chosen in the group constituted by $Na_2CO_3$, $K_2CO_3$, $Na_2SO_4$, $K_2SO_4$, $Na_2SO_3$, $Na_3PO_4$, $K_3PO4$ and the combinations thereof.

It is to be noted that said source of polyvalent anions is preferably added in an amount sufficient to raise the pH of said solution to 6.5–9.5, preferably 8.5. The addition of polyvalent anions serves to two objectives.

The addition of polyvalent anins serves to two objectives.

First, they precipitate out $Ca^{2+}$ and $Mg^{2+}$ usually contained in the solution which in turn increases the number of polyvalent anion equivalents with regard to the number of polyvalent cation equivalents.

Secondly, they increase themselves the number of polyvalent anions with regard to the number of polyvalent cation equivalents. After the addition of these polyvalent anions, the resulting precipitate, even if not visible, preferably should be removed, although in some cases, it is not necessary. The process of removal, after treatment of the sugar solution includes, but is not limited to, a conventional process filtration, a membrane filtration, a cross flow membrane filtration, floating and settling.

Therefore, according to another preferred embodiment, the above processes of the invention further comprise the step of filtering said solution, this step being advantageously carried out after said step of treating said solution and before the crystallization operation.

It is preferred that said filtering step includes a membrane filtration, such as a microfiltration, ultrafiltration or nanofiltration using an organic or mineral membrane well-known in the art.

During the processing of the sugar solution to produce crystallized sugar, the color of said solution should be kept as low as possible, by minimizing color formation. This can be achieved by addition of $SO_2$ and/or any source of $SO_2$ such as a metabisulfite, for example sodium metabisulfite.

Said addition, which is nothing else than a sulfitation, is carried out after the step of treating said solution and before or after the above mentioned filtration. It is to be noted that $SO_2$ and/or the source of $SO_2$ is preferably added in an amount sufficient to decrease the pH of the solution to 6.0–8.5, preferably 8.0; it is also essential to bring down the pH with $SO_2$ in order to avoid excessive color formation due to high pH.

Table 1 below shows the effect of $SO_2$ addition on color after heating (95° C., 1 hour) for various kinds of sugar solution.

TABLE 1

| Sample | Brix | Original color | Color after heating | Color after $SO_2$ treatment and heating | % decrease in color |
|---|---|---|---|---|---|
| Affination syrup (cane) | 50.16 | 40,365 | 42,900 | 36,652 | 14.6 |
| Raw sugar (cane) | 50.86 | 7577 | 8053 | 7081 | 12.0 |
| Beet std. Liquor | 50.40 | 3070 | 3214 | 2738 | 14.8 |
| Beet molasses extract | 51.61 | 7291 | 7309 | 6318 | 13.6 |

It is apparent that $SO_2$, not only reduces the color of the sugar solution to be crystallized, by chemical reduction action, but also prevents the color formation during processing/heating. In addition, the oxidation products of $SO_2$ are also polyvalent anions which increase the number of polyvalent anion equivalents, resulting in lower color of the crystallized sugar.

According to an embodiment of the invention, the crystallization procedure is carried out so as to obtain large crystals.

In this respect, it is to be noted that an important amount of color is present on the surface of the sugar crystals. Therefore, for a given weight of sugar crystals, the total surface area of the crystals increases when the size of the crystals decreases and, consequently the total color increases; that is the reason why it is advantageous to control the crystallization procedure in order to produce large crystals.

Furthermore, according to the present invention, it is also advantageous that the crystallization process comprises a step of washing of the formed crystals with water to remove all or part of the surface color, to further decrease the sugar color.

DETAILED DESCRIPTION OF THE INVENTION

This description is made by reference to the following Comparison example and Examples 1 to 4 and to above FIGS. 1 to 4.

COMPARISON EXAMPLE

A sugar juice is clarified by using lime and a flocculent to produce a clarified sugar juice with a color of about 11,000 I.C.U. This juice is used as starting material in the process of FIG. 1.

After evaporation of said clarified sugar juice, the resultant syrup is going to a pan house where it is submitted to a crystallization process to produce a raw sugar with a color of about 3,000 I.C.U. (O.I.=about 25%) and a color of about 700 I.C.U. after a washing with water (in an amount of 2% by weight of the raw sugar), a color of 700 I.C.U. corresponding to an occlusion index O.I. of about 6%.

Example 1

Figure 1:
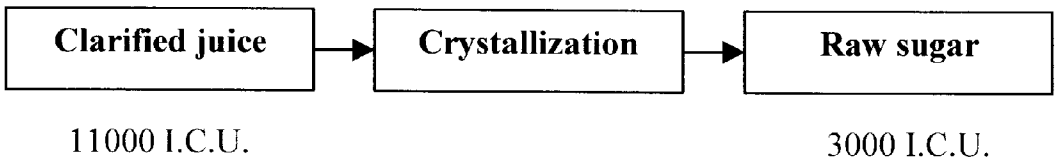
FIG. 1 is a simplified flow diagram of a conventional process for manufacturing raw sugar from a clarified sugar juice.
Figure 2:
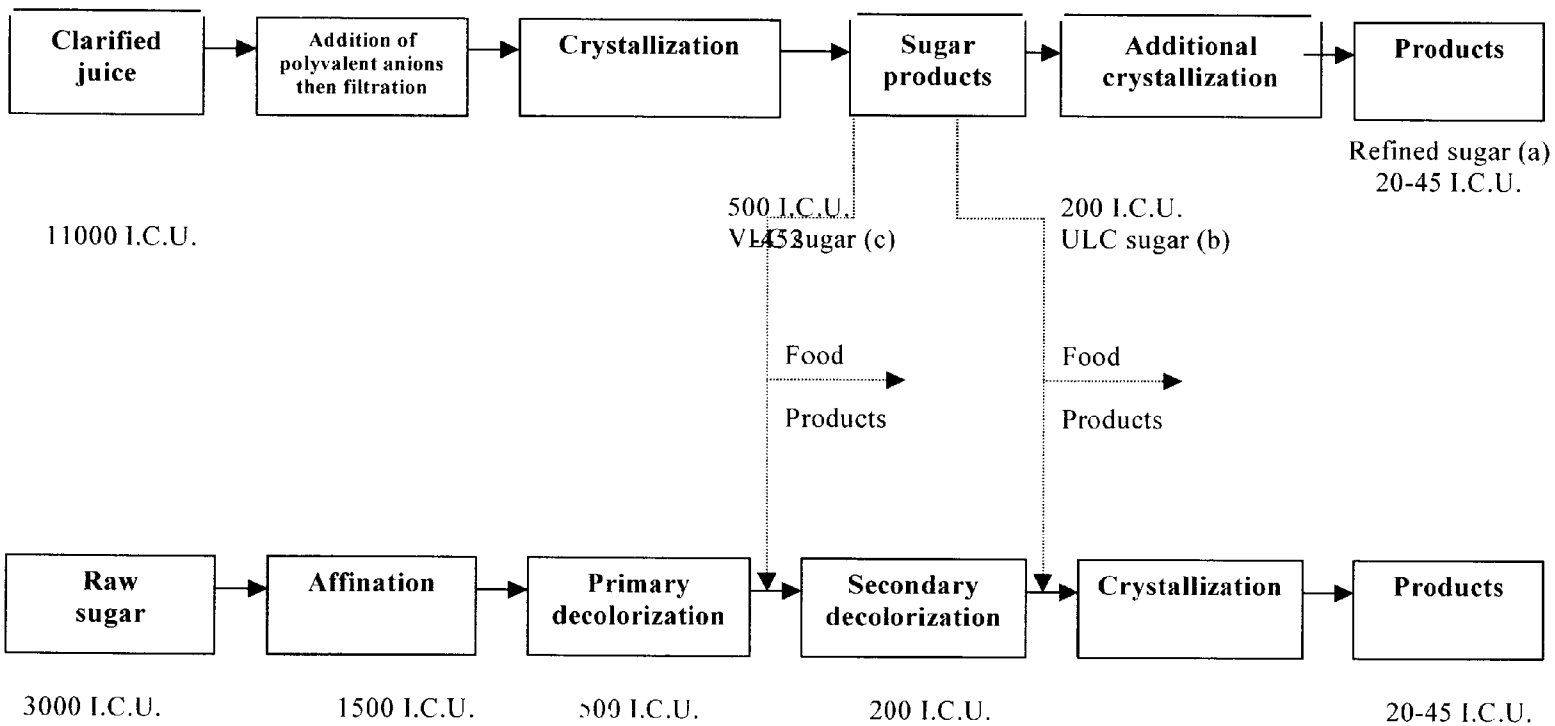
FIG. 2 is a simplified flow diagram of the process of FIG. 1, but modified according to the present invention; it further shows a simplified flow diagram of a conventional sugar refining process.
Figure 3:
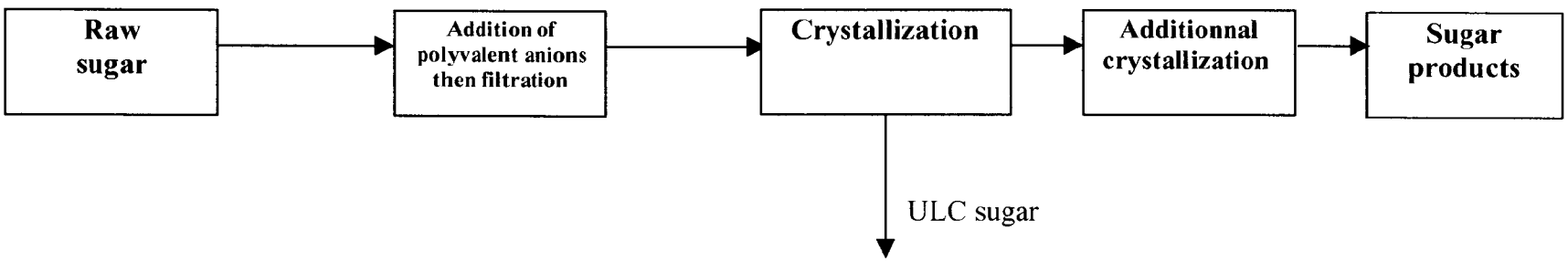
FIG. 3 shows a simplified flow diagram of a process according to the present invention, for manufacturing refined sugar from raw sugar.

The same clarified sugar juice as that prepared in above Comparison example is submitted to the process of the present invention (see FIG. 2). More precisely, starting with a clarified sugar juice having a pH of about 6.0, at a temperature of 80 to 100° C., preferably 80 to 85° C., $Na_2CO_3$ is first added to raise the pH to 6.5–9.5, preferably 8.5. After a contact time of about 2 to 30 minutes, preferably 15 minutes, $SO_2$ is added to decrease the pH to 6.0–8.5, preferably 8.0.

The treated juice thus obtained is then filtered on a membrane of organic or mineral nature; the cut-off of said membrane is advantageously in the range of 10 kD to 0.5 μm; for example, use may be made of a mineral membrane having a cut-off of about 300 kD and manufactured by ORELIS COMPANY.

As a result of the above treatment (addition of polyvalent anions $CO_3^{2-}$, $SO_3^{2-}$ and $SO_4^{2-}$), the sugar solution obtained has a color of about 7,000 I.C.U. and the crystallized sugar obtained as in above Comparison example and washed with 2% by weight of water has a color reduced to about 200 I.C.U. (O.I.≅2.85%); said washed crystallized sugar is called VLC sugar.

It is to be noted that by increasing the washing to 4% or 6%, the sugar color may be reduced to less than 100 I.C.U. and the crystallized sugar obtained by such a washing is called ULC sugar.

Moreover, an additional crystallization of the resulted sugar products produced by the first crystallization, provides a refined sugar with a color of about 20–45 I.C.U.

For comparison way, FIG. 2 also comprises a flow diagram of a conventional sugar refinery process starting from a raw sugar having a color of about 3,000 I.C.U., and comprising the successive steps of affination (leading to a color of about 1,500 I.C.U.), primary decolorization (leading to a color of about 500 I.C.U.), secondary decolorization (leading to a color of about 200 I.C.U.) and crystallization which provides a refined sugar of about 20–45 I.C.U.

The above shows that according to the present invention, it is possible to produce (i) refined sugar without the need of any of the refining operations of the conventional process, resulting in a considerable energy saving, (ii) ULC sugar without using any of the conventional affination, primary decolorization and secondary decolorization operations, eliminating thereby the environmental problems due to carbonation and phosphatation and reducing energy consumption, (iii) VLC sugar without using any of the conventional affination and primary decolorization operations.

Example 2

A melted raw sugar (about 2,500 I.C.U.) is submitted to a conventional crystallization process; the crystallized sugar so produced has a color of about 260 I.C.U. (O.I.≅10%).

Furthermore, the above melted raw sugar clarified and then treated according to the present invention (FIG. 3), i.e. submitted to the addition of polyvalent anions and then filtrated, has a color of about 1,600 I.C.U. It is then submitted to a crystallization which produces a crystallized sugar with a color of about 60 (O.I.≅3.75%); a classical washing of said crystallized sugar with 2% by weight of water and a centrifugal separation of the refined sugar provides a sugar having a color of about 26 I.C.U. (O.I.≅1.60).

Example 3

A sugar solution obtained from an affination process and having a color of 20,000 to 40,000 I.C.U. normally would produce a sugar with a color of about 3,000 to 5,000 I.C.U. with an occlusion index averaging about thirteen percent (13%). However, if the sugar solution is treated in accordance with this invention, the occlusion index can be reduced to less than 5%. For example, an affination syrup with an original color of 21,360 I.C.U. gives a sugar with a color of 613 I.C.U. by using the present invention, with an occlusion index of ≅3%.

Moreover, the treatment of sugar liquor/syrup/juice, etc. in accordance with the present invention will also remove impurities affecting the rate of crystallization. For example (see table 2 below), compared with a non-treated affination syrup, the treatment of an affination syrup in accordance with this invention increased the crystal growth rate by 49%, 38%, 37% for the first hour, second hour and third hour of sugar crystallization (vacuum pan), respectively. The increase in crystal growth rate will increase the factory/plant capacity, reduce sucrose loss and increase yield.

TABLE 2

Effect of treatment on crystal growth rate. Test done on affination syrup (original crystal average length : 1340μ)

| | Average crystal length (μm) | | | Average growth rate (μm/min) | | |
|---|---|---|---|---|---|---|
| Sample | 1st hr | 2nd hr | 3rd hr | 1st hr | 2nd hr | 3rd hr |
| Affination syrup | 1624 | 1746 | 1841 | 4.7 | 3.4 | 2.7 |
| Treated affination syrup | 1760 | 1907 | 2012 | 7.0 | 4.7 | 3.7 |
| % increase | | | | 49% | 38% | 37% |

Figure 4A:
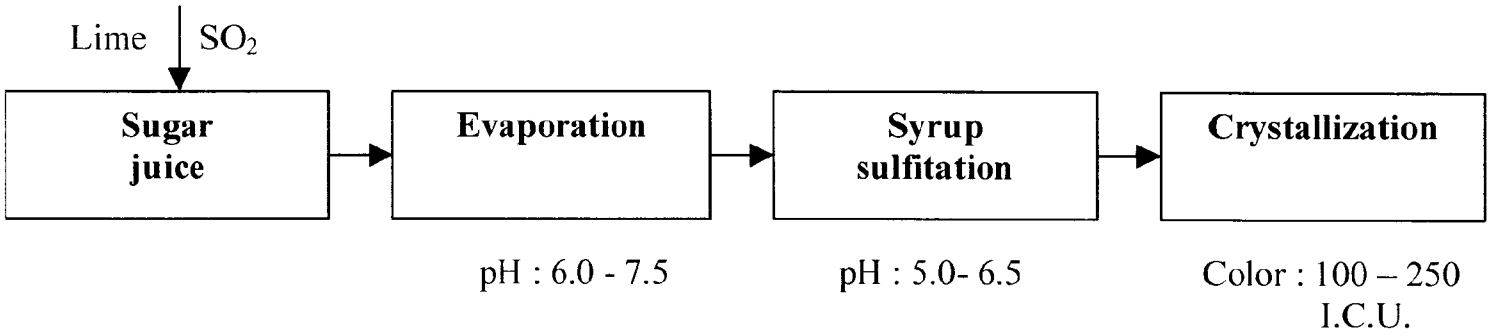
FIG. 4*a* shows a simplified flow diagram of a conventional process for production of plantation white sugar, including a sulfitation step.
Figure 4B:
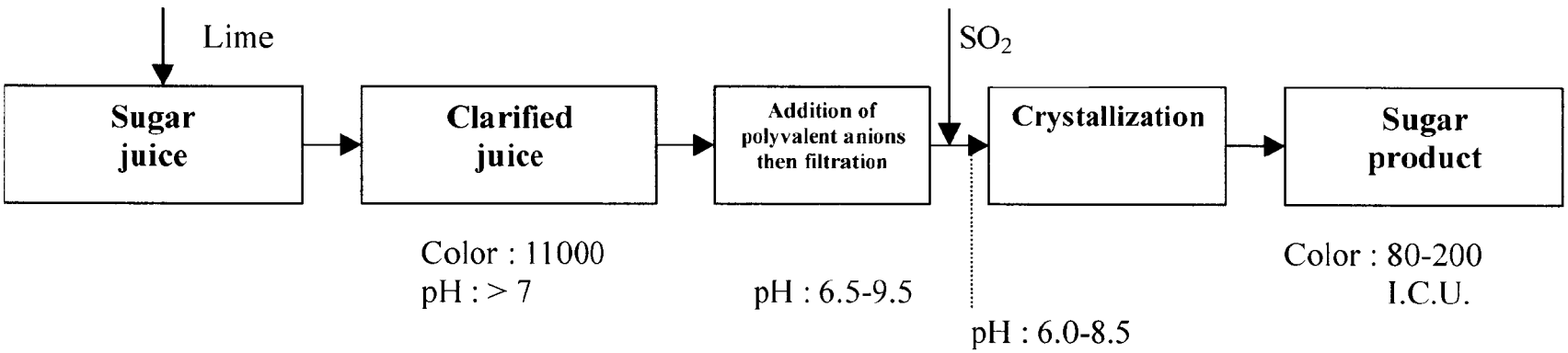
FIG. 4*b* shows a simplified flow diagram of a process according to the present invention for production of white sugar without excessive use of $SO_2$.

Example 4 a) As shown by FIG. 4*a*, the conventional process comprises a step of treating a sugar juice with lime (for clarification) and $SO_2$ for a first sulfitation. The resulting juice of a pH of about 6.0–7.5 is then concentrated (by evaporation) and submitted to a further sulfitation; the obtained syrup having a pH of about 5.0–6.5 is then submitted to a crystallization providing a crystallized sugar of about 100–250 I.C.U. with a $SO_2$ content higher than 20 ppm.

Such a crystallized sugar which has a $SO_2$ content in excess of the FDA labelling requirement of less than 10 ppm is unsuitable for use in the beverage industry. Moreover, due to the involved low pH, sucrose inversion takes place and the invert sugar degrades to organic acids which subsequently creates color; moreover, the produced organic acids auto-catalyze the sucrose inversion by lowering pH, i.e. a "vicious cycle".

b) According to the invention process (see FIG. 4*b*), the sugar juice is first clarified (with lime) and the clarified juice (having a color of 11,000 I.C.U. and a pH>7) is added with polyvalent anions (for example $Na_2CO_3$ to reach a pH of 6.5–9.5; contact time 2–30 minutes; 80–100° C.) and then filtered on a tight filtration medium such as the membrane described in above Example 1. The resulting juice is then submitted to a sulfitation step without excessive use of $SO_2$ (to reach a pH of 6.0–8.5) and subsequently to a crystallization step which provides a sugar product of 80–200 I.C.U. $SO_2$ is used in a low amount avoiding the "vicious cycle" alluded above; therefore, the present invention improves the yield by avoiding sucrose destruction due to a low pH and improves the product quality.

What is claimed is:

1. A process for manufacturing crystallized sugar from an aqueous sugar solution containing colorants and polyvalent cations comprising $Ca^{+2}$ and $Mg^{+2}$ ions, said process comprising the steps of:

(a) adding a source of $CO_3^{-2}$ anions to said solution to increase the number of polyvalent anion equivalents with respect to the number of polyvalent cation equivalents thereby forming a second solution;

(b) adding $SO_2$ or a source of $SO_2$ to said second solution to form a third solution;

(c) filtering said third solution on a membrane to form a filtered solution; and (d) crystallizing said filtered solution.

2. The process of claim 1, wherein said source of $CO_3^{-2}$ anions is selected from the group consisting of $Na_2CO_3$, $K_2CO_3$ and mixtures thereof.

3. The process of claim 1, wherein said source of $CO_3^{-2}$ anions is added in an amount sufficient to raise the pH of said solution to 6.5–9.5.

4. The process of claim 1 wherein said source of $SO_2$ is a metabisulfite.

5. The process of claim 4 wherein said metabisulfite is sodium metabisulfite.

6. The process of claim 1, wherein said step of filtering on a membrane is micro-, ultra- or nanofiltration.

7. The process of claim 1, wherein $SO_2$ or the source of $SO_2$ is added in an amount sufficient to decrease the pH of said third solution to 6.0–8.5.

8. A process for manufacturing crystallized sugar from an aqueous sugar solution containing colorants and polyvalent cations, comprising $Ca^{+2}$ and $Mg^{+2}$ ions, said process comprising the steps of:

(a) adding a source of $CO_3^{-2}$ anions to said solution to increase the number of polyvalent anion equivalents with respect to the number of polyvalent cation equivalents, thereby forming a second solution;

(b) filtering said second solution on a membrane to form a filtered solution; and (c) adding $SO_2$ or a source of $SO_2$ to said filtered solution to form a third solution;

(d) crystallizing said third solution.

9. The process of claim 8, wherein said source of $CO_3^{-2}$ anions is selected from the group consisting of $Na_2CO_3$, $K_2CO_3$ and mixtures thereof.

10. The process of claim 8, where said source of $CO_3^{-2}$ is added in an amount sufficient to raise the pH of said solution to 6.0–9.5.

11. The process of claim 8, wherein said source of $SO_2$ is a metabisulfite.

12. The process of claim 11 wherein said metabisulfite is sodium metabisulfite.

13. The process of claim 8, wherein said step of filtering on a membrane is micro-, ultra or nanofiltration.

14. The process of claim 8, wherein $SO_2$ or the source of $SO_2$ is added in an amount sufficient to decrease the pH of the solution to 6.0–8.5.

* * * * *